US006962268B2

(12) United States Patent
Bruat et al.

(10) Patent No.: US 6,962,268 B2
(45) Date of Patent: Nov. 8, 2005

(54) DEVICE FOR STORING AND MIXING TWO GASES

(75) Inventors: Josyane Bruat, Les Ulis (FR); Clarisse L'Heveder, Paris (FR)

(73) Assignee: L'Air Liquide, Société Anonyme à Directoire et Conseil de Surveillance pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 10/499,874

(22) PCT Filed: Nov. 28, 2002

(86) PCT No.: PCT/FR02/04090

§ 371 (c)(1),
(2), (4) Date: Jan. 10, 2005

(87) PCT Pub. No.: WO03/054441

PCT Pub. Date: Jul. 3, 2003

(65) Prior Publication Data

US 2005/0115987 A1 Jun. 2, 2005

(30) Foreign Application Priority Data

Dec. 20, 2001 (FR) ..... 01 16584

(51) Int. Cl.[7] ..... F17C 13/04
(52) U.S. Cl. ..... 222/3; 222/145.8; 137/264; 137/606; 137/897
(58) Field of Search ..... 222/3, 145.5, 145.7, 222/145.8; 137/264, 606, 897

(56) References Cited

U.S. PATENT DOCUMENTS

| | | | | |
|---|---|---|---|---|
| 2,200,675 | A | 5/1940 | Northcutt | |
| 3,635,375 | A | 1/1972 | Gaetke | |
| 3,645,291 | A | 2/1972 | Finney | |
| 4,460,010 | A | 7/1984 | Paravigna et al. | |
| 4,485,739 | A * | 12/1984 | Emmett | 137/606 |
| 4,734,371 | A * | 3/1988 | Schmolke et al. | 222/3 |
| 4,923,394 | A | 5/1990 | Fumino | |
| 5,261,452 | A * | 11/1993 | McAndrew et al. | 137/606 |
| 5,678,602 | A | 10/1997 | Cannet et al. | |
| 6,314,986 | B1 * | 11/2001 | Zheng et al. | 137/597 |
| 6,343,476 | B1 * | 2/2002 | Wang et al. | 62/46.1 |
| 6,418,965 | B2 | 7/2002 | Bryselbout | |

FOREIGN PATENT DOCUMENTS

| | | |
|---|---|---|
| EP | 1 167 863 A1 | 1/2002 |
| WO | WO 96 07843 | 3/1996 |

OTHER PUBLICATIONS

International Search Report for PCT/FR02/04090.

* cited by examiner

*Primary Examiner*—Eric Keasel
(74) *Attorney, Agent, or Firm*—Elwood Haynes

(57) ABSTRACT

An apparatus for storing and mixing two pressurized gases. The apparatus has an outer container for storing the first gas and an inner container, situated inside the outer container, for storing the second gas. The gases exit their containers through outlet passages, are mixed together resulting in a mixture which leaves the apparatus through and output channel.

12 Claims, 1 Drawing Sheet

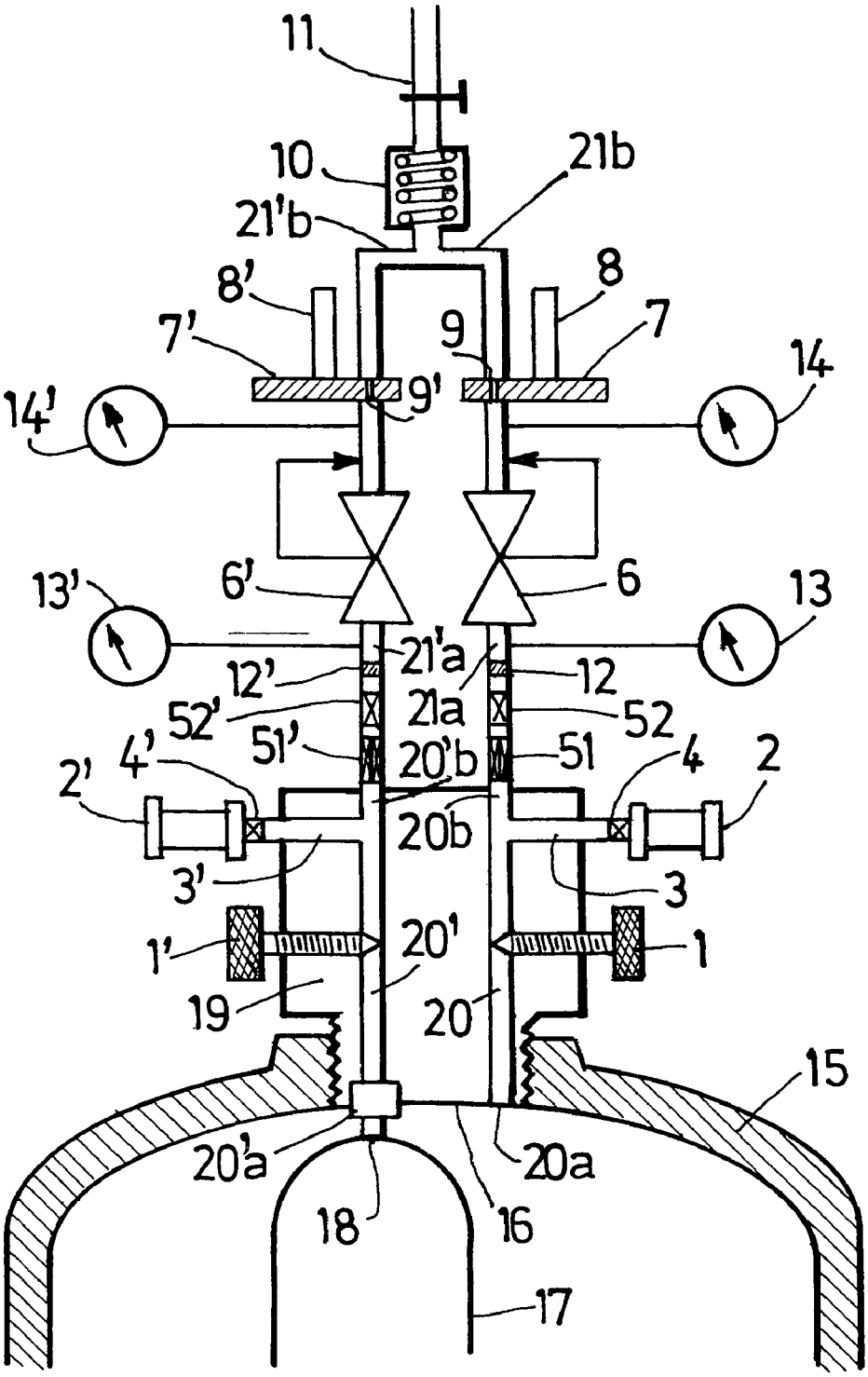
11
10
21b
21'b
8'
8
7'
9
7
14
14'
9'
6'
6
13'
13
21'a
12'
12
21a
52'
52
51'
20'b
51
4'
4
2'
2
20b
3'
3
1'
20'
1
19
20
15
20'a
20a
18
16
17

DEVICE FOR STORING AND MIXING TWO GASES

BACKGROUND

The subject of the present invention is a device for storing and mixing two gases or two gas mixtures under pressure.

To prepare and store mixtures having a very low content, for example a few parts per billion (ppb) or fractions of parts per million (ppm), of an active gas such as $SO_2$ or NO or $NO_2$ in diluent gases such as $N_2$ is relatively tricky and often gives rise to problems of preservation of the mixture in their storage bottle and of their use in situ.

This is why it has been proposed to produce these types of mixture by means of a diluter. To use this technique, it is necessary to have a bottle of the gas to be diluted and its pressure relief valve, a bottle of the diluent gas and its pressure-relief valve, and a diluter-mixer. If the time needed to purge the circuits that connect these various components is taken into account, together with the cost of these various components, to have available the mixture with a very low content is prohibitive.

SUMMARY

It is an objective of the present invention therefore to provide a device for storing and mixing two gases or two gas mixtures that makes it possible to produce the final mixture in situ with a precision in the content of the various components that is at least as good as in the prior techniques and permits certain of the gases to have very low contents, of the order of a fraction of a ppm or a few ppb.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein:

FIG. 1 illustrates one embodiment of the storage and mixing device, as seen in a section view.

DESCRIPTION OF PREFERRED EMBODIMENTS

To achieve this objective according to the invention, the device for storing and mixing two gases or gas mixtures under pressure comprises:

an outer container (15) containing the first of said gases and provided with an opening (16);

an inner container (17) placed inside said outer container, containing the second gas and provided with an opening (18);

a two-way cock (19) comprising:

a body fixed in a sealed manner in the opening of the outer container, a first passage (20') having an internal end (20'*a*) connected to the opening of the inner container (18) and an external end (20'*b*), said first passage being equipped, between its two ends, with controllable closure means (1') and with a filling channel (3'), and a second passage (20) having an internal end (20*a*) opening into the outer container (15) and an external end (20*b*), said second passage being equipped with controllable closure means (1) and with a filling channel (3);

two output channels (21, 21') each connected to an external end (20*b*, 20'*b*) of each passage (20, 20') of the cock (19), each output channel having an internal end (21*a*, 21'*a*) and an external end (21*b*, 21'*b*), and comprising in succession:

a first and a second pressure-regulating means (6, 6'), and at least one controllable flow-rate selection barrel (7, 7') connected to one of the pressure-regulating means (6, 6'), the barrel (7, 7') allowing orifices (9, 9') of various sizes to be selected for the output channel (21, 21') fitted with the barrel; and a mixing chamber (10) into which the external ends (21*b*, 21'*b*) of the output channels (21, 21') run.

The overall mixing and storing device will be described with reference to the FIGURE. This device firstly consists of a pressure-resistant outer bottle 15 designed to contain the diluent gas or gas mixture. The bottle 15 has an upper opening 16 in which a two-way cock 19 is fitted, the body of said cock being fixed in a sealed manner in the opening 16. The two-way cock 19 essentially comprises two passages 20 and 20', a first end 20*a*, 20'*a* of which runs into the lower face of the body of the two-way cock and the second end 20*b*, 20'*b* of which runs into the upper part of the body of the two-way cock. Each passage 20, 20' has means 1, 1' for closing off said passages. These closure means 1, 1' are controllable. They generally consist of high-pressure valves. Each passage 20 and 20' also includes a filling channel 3, 3' drilled through the body of the cock: a first end of each filling channel 3 or 3' runs into a passage 20 or 20' and the other end at the outside of the body of the cock 19. The latter, outer, end may run into a filling adapter 2, 2' for connection to a gas source. This filling channel allows the containers to be filled without removing the two-way cock 19. A nonreturn valve 4, 4' may be placed on each filling channel 3 and 3' of the cock 19, more precisely between the filling adapter and the filling channel. The nonreturn valves 4, 4' may be blocked off in order to purge the containers. Preferably, the filling adapter 2, 2' is fitted with a polarizer so as not to confuse the inputs of the two containers and to prevent the user from being able to fill the containers himself.

Mounted inside the outer container 15 is an inner pressure-resistant bottle 17, the opening 18 of which is connected to the end 20'*a* of the first passage of the two-way cock, generally by a pipe.

The external ends 20*b*, 20'*b* of each passage 20 of the cock 19 are each connected to an output channel 21, 21'. These output channels include pressure-regulating means 6, 6' which are generally two-stage pressure-regulating valves. It goes without saying that other types of pressure-regulating valve could be used. These pressure-regulating means 6 and 6' are regulated in order to deliver an output pressure that is preferably identical for both gases. A residual pressure valve 51, 51' and optionally a nonreturn valve 52, 52' may also be placed between the external end 20*b*, 20'*b* of each passage 20, 20' of the cock 19 and the internal end 21*a*, 21'*a* of each output channel 21, 21'. These valves are therefore placed between the closure means 1, 1' of the containers and the pressure-regulating means 6, 6' and downstream of the channels 3, 3' for filling the containers. The residual pressure valves prevent the containers from being completely emptied when the device is being used since these valves allow the gas to flow only above a certain predetermined pressure. Each of these residual pressure valves 51, 51' may also be supplemented with a nonreturn valve 52, 52' that prevents the gas from getting back into the container after it has flowed into one of the pressure-regulating means 6, 6'. This arrangement makes it possible to prevent an impurity from getting into the container once the gas in the container has been delivered. This also avoids having to fill the containers by a series of compression and purge steps at each new filling operation.

The device also includes, on at least one of the output channels 21, 21', and preferably on both, and downstream of the pressure-regulating means 6, 6', a flow-rate selection barrel 7, 7', allowing orifices 9, 9' of various sizes to be selected for the output channel or channels 21, 21' equipped with the barrel.

The selection of the orifices may be performed by any type of manual control means 8, 8'. These barrels allow selection of the diameter of the outlet orifice for the gases leaving the containers and therefore the flow rates of the gases flowing to the external end 21*b*, 21'*b* of the output channels 21, 21'. The barrels 7 and 7' are orientated so as to place the orifices 9 and 9' so as to face the end of the pressure-regulating means 6 and 6'. The selection of a pair of adjustment positions of the barrels, or of the adjustment position of the single barrel (if only one output channel 21 or 21' is equipped with such a flow-rate adjustment means), results in the selection of the desired concentration in the final mixture. Preferably, these barrels have three positions, namely a closed position, which prevents the gas from flowing and, for example, two positions in a flow rate ratio of a half. These three-position barrels make it possible to cause a single gas, especially the diluent gas in the outer container, to flow, which gas then flows out of the device; this position makes it possible, for example, to have a zero reference when calibrating an analytical apparatus. These barrels also make it possible to have, at the external end of the output channels 21 and 21', two gas concentrations, for example in a ratio of 2, and to be able to calibrate a measurement apparatus by providing a full-scale calibration point and another point at one half of full scale. This type of barrel may correspond in particular to that disclosed in application WO 96/07843. According to one advantageous embodiment of the invention, the orifices 9, 9' of the barrels 7, 7' are equipped with a low-pressure particle filter.

The device according to the invention may include a high-pressure particle filter 12, 12' placed at the external end 20*b*, 20'*b* of each passage 20, 20' of the cock 19.

The device may include high-pressure gages 13, 13' placed on each output channel 21, 21' upstream of the pressure control means 6, 6'. It may also include low-pressure gages 14, 14' placed after each pressure control means 6, 6'. The high-pressure gages 13, 13' placed upstream of the pressure control means 6, 6' are used to read the pressure in each of the containers, and the low-pressure gages 14, 14' placed after the pressure control means 6, 6' allow the user of the device to adjust said pressure control means 6, 6' to the desired output pressure.

The external ends of the output channels 21, 21' are connected to a mixing chamber 10, the outlet of which is itself connected to a single outlet terminating in an output valve 11. This chamber preferably has a particular geometry that allows the two gases or gas mixtures coming from each of the pipes to be mixed, so as to homogenize the mixture while it is flowing through this space.

According to the invention, the gas mixture to be diluted may already be diluted in acceptable proportions, for example of the order of a few ppm, in the inner container, while the outer container contains the diluent gas. The degree of dilution of the active gases in the inner container may be initially established in an easy and precise manner, and its storage raises no particular problems. When using the final mixture, it is possible to produce the latter in situ by opening the two containers and choosing the position of the flow-rate adjustment barrel that allows the degree of dilution of the two gases to be set: what is obtained at the outlet of the whole device is a mixture with the desired content of active gases, with the desired flow rate and with the desired pressure thanks to the presence of the pressure-relief valves and of the orifices of the barrel that are chosen. Preferably, the gas mixtures or the gases contained in the two containers are at the same pressure and the ratio of the volumes of the two containers is equal to the ratio of the quantities of gas or gas mixtures to be withdrawn from the two containers in order to obtain the final mixture. It should also be emphasized that, after installation of the inner container and of the two-way cock inside the outer container, the two containers can be easily filled via the two-way cock.

Preferably, the inner container has a volume of the order of 1/100 of the volume of the outer container, so that the degree of dilution corresponding to the mean calibrated orifice on each of the two output channels means that the two containers empty at the same rate. The two residual pressure valves may either be connected to an alarm, informing the user that one of the containers is empty, or connected together so that the closure of one of them causes the second to close and thus prevents any withdrawal from just one of the two containers when only one is empty. However, the relative dimensions of the two containers are not fixed in this ratio—it is the ratio of their volumes that determines the mean degree of dilution of the gas.

The use of the device described in relation to the FIGURE is clearly apparent. In an initial phase, the inner container 17 fixed to the two-way cock 19 is placed inside the outer container 15 and the body of the two-way cock is fixed in a sealed manner in the opening 16 of the outer container. The initial filling of the inner container 17 and of the outer container 15 then takes place by means of the passages 20 and 20'. After this filling operation, the closure means 1 and 1' close off these two containers. In this state, the gases or gas mixtures contained in the containers 15 and 17 may be stored for the desired time. It goes without saying that the inner container 17 must preferably have transverse dimensions that are smaller than the cross section of the opening 16 of the outer container 15 so as to allow it to be fitted inside the container 15.

The use of the device according to the invention is particularly suitable for preparing a mixture of CO and air from a mixture of CO and $N_2$ stored in the inner container and from a mixture of air and $O_2$ stored in the outer container. The CO may have a concentration of between 1 and 10 000 ppm in $N_2$.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. An apparatus for storing and mixing two pressurized gases comprising:

a) an outer container containing the first of said gases, said outer container having an opening;

b) an inner container located inside said outer container, containing the second of said gases, said inner container having an opening;

c) a two-way cock, said cock further comprising:

1) a body fixed in a sealed manner in said outer container opening;

2) a first passage further comprising:

i) an internal end connected to said inner container opening;

ii) an external end;

iii) a controllable closure means located between said ends; and iv) a filling channel located between said ends; and 3) a second passage further comprising;

i) an internal end opening into said outer container;

ii) an external end;

iii) a controllable closure means; and iv) a filling channel;

d) two output channels, each connected to an external end of said passages, said channels further comprising internal and external ends and said channels further comprising, in succession;

1) a first and a second pressure-regulating means; and 2) at least one controllable flow-rate selection barrel connected to one of said pressure-regulating means, said barrel allowing orifices of various sizes to be selected for the output channel fitted with said barrel; and e) a mixing chamber into which said external ends of said output channel run.

2. The apparatus of claim 1, wherein said gases are gas mixtures.

3. The apparatus of claim 1, wherein said controllable closure means comprises high-pressure valves.

4. The apparatus of claim 1, wherein a nonreturn valve is located on each filling channel.

5. The apparatus of claim 1, wherein a residual pressure valve is located between said external end of each passage and said internal end of each output channel.

6. The apparatus of claim 1, wherein a nonreturn valve is placed between said external end of each passage and said internal end of each output channel.

7. The apparatus of claim 1, wherein a high-pressure particle filter is located at said external end of each passage.

8. The apparatus of claim 1, wherein a high-pressure gage is located on each output channel upstream of said pressure-regulating means.

9. The apparatus of claim 1, wherein a low-pressure gage is placed after each pressure-regulating means.

10. The apparatus of claim 1, wherein each orifice of said barrel is equipped with a low-pressure particle filter.

11. A method of preparing a mixture of CO and air comprising combining a first mixture of CO and $N_2$ with a second mixture of air and $O_2$ in an apparatus, said apparatus further comprising:

a) an outer container containing said first mixture, said container having an opening;

b) an inner container located inside said outer container, said inner container containing said second mixture and having an opening;

c) a two-way cock, said cock further comprising:

1) a body fixed in a sealed manner in outer container opening;

2) a first passage further comprising:

i) an internal end connected to said inner container opening;

ii) an external end;

iii) a controllable closure means located between said ends; and iv) a filling channel located between said ends; and 3) a second passage further comprising:

i) an internal end opening into said outer container;

ii) an external end;

iii) a controllable closure means; and v) a filling channel;

d) two output channels, each connected to an external end of said passages, said channels further comprising internal and external ends and said channels further comprising in succession;

1) a first and a second pressure-regulating means; and 2) at least one controllable flow-rate selection barrel connected to one of said pressure-regulating means, said barrel allowing orifices of various sizes to be selected for the output channel fitted with said barrel; and e) a mixing chamber into which said external ends of said output channel run.

12. The method of claim 11, further comprising storing said first mixture in said inner container and storing said second mixture in said outer container.

* * * * *